US009028003B2

(12) United States Patent
Yeh

(10) Patent No.: US 9,028,003 B2
(45) Date of Patent: May 12, 2015

(54) FULLY UPHOLSTERED READY-TO-ASSEMBLE CHAISE LOUNGE AND SOFA

(71) Applicant: COA, Inc., Santa Fe Springs, CA (US)

(72) Inventor: Michael Yeh, Santa Fe Springs, CA (US)

(73) Assignee: COA, Inc., Santa Fe Springs, CA (US)

( * ) Notice: Subject to any disclaimer, the term of this patent is extended or adjusted under 35 U.S.C. 154(b) by 0 days.

(21) Appl. No.: 14/012,902

(22) Filed: Aug. 28, 2013

(65) Prior Publication Data

US 2015/0061344 A1 Mar. 5, 2015

(51) Int. Cl.

| | |
|---|---|
| ***A47C 7/40*** | (2006.01) |
| ***A47C 7/02*** | (2006.01) |
| ***A47C 13/00*** | (2006.01) |
| ***A47C 7/24*** | (2006.01) |
| ***A47C 7/42*** | (2006.01) |
| ***A47C 4/02*** | (2006.01) |

(52) U.S. Cl.

CPC ..... *A47C 13/005* (2013.01); *A47C 7/24* (2013.01); *A47C 7/42* (2013.01); *A47C 4/028* (2013.01)

(58) Field of Classification Search

CPC ..... A47C 4/02; A47C 4/028; A47C 7/42

USPC ..... 297/440.14, 440.15

See application file for complete search history.

(56) References Cited

U.S. PATENT DOCUMENTS

| | | | | |
|---|---|---|---|---|
| 1,273,968 | A * | 7/1918 | Whedon | 297/440.15 |
| 5,352,017 | A * | 10/1994 | Berning | 297/248 |
| 5,738,414 | A * | 4/1998 | Wieland et al. | 297/440.1 |
| 6,241,317 | B1 * | 6/2001 | Wu | 297/440.23 |
| 7,922,253 | B2 | 4/2011 | Chen | |
| 8,322,793 | B2 | 12/2012 | Chen | |
| 8,777,319 | B2 * | 7/2014 | Brandtner et al. | 297/440.15 |

* cited by examiner

*Primary Examiner* — Milton Nelson, Jr.
(74) *Attorney, Agent, or Firm* — Cislo & Thomas LLP

(57) ABSTRACT

A stylish ready-to-assemble chaise lounge and sofa which may be easily and quickly assembled by a consumer, is provided. The invention is a kit from which either a stylish chaise lounge or a sofa may be easily assembled by a consumer using a single Allen wrench. The kits, both chaise and sofa, comprise a seat base, a long side seatback and a short side seatback, feet, fasteners and cushions. With regard to the chaise, the long and short side chaise seatbacks have rectangular lower portions with upper portions featuring a flowing curved "waterfall" seating surface which improves the comfort of a user leaning back against the seatback.

18 Claims, 9 Drawing Sheets

FULLY UPHOLSTERED READY-TO-ASSEMBLE CHAISE LOUNGE AND SOFA

BACKGROUND OF THE INVENTION

1. Field of the Invention

The present invention relates generally to the field of ready-to-assemble furniture and more particularly to a fully upholstered, ready-to-assemble chaise lounge and sofa that can be assembled by a consumer using a single Allen wrench.

2. Background of the Invention

Ready-to-assemble furniture is furniture which is packaged for shipment in disassembled form, with assembly to be done by the consumer or end user. Examples of existing ready-to-assemble non-upholstered furniture include bookcases, television stands, and simple chairs and benches.

The field of ready-to-assemble furniture packaged for retail sale has generally been limited to pieces of furniture which are utilitarian and non-upholstered. As such, prior ready-to-assemble furniture does not satisfy the need for pieces of fully upholstered furniture such as chaise lounges or sofas, which can serve as the primary pieces of furniture within a living room, den or other room in a home. A few attempts at fully upholstered sofas and the like have been made previously. However, prior art designs for fully upholstered, ready-to-assemble furniture have tended to lack comfort, be pedestrian in appearance and have complicated assembly procedures.

A need exists in the art for comfortable, stylish, fully upholstered, ready-to-assemble chaise lounges and sofas that are of high quality, compact and easily transportable when dissembled, and yet can be readily assembled by a consumer with simple hand tools.

SUMMARY OF THE INVENTION

The present invention solves the problems of the prior art by providing a stylish ready-to-assemble chaise lounge and sofa which may be easily and quickly assembled by a consumer. The invention is a kit from which either a stylish chaise lounge or a sofa may be easily assembled by a consumer using a single Allen wrench. The kits, both chaise and sofa, comprise a seat base, a long side seatback and a short side seatback, furniture legs, fasteners and cushions. With regard to the chaise, the long and short side chaise seatbacks have rectangular lower portions with upper portions featuring a flowing curved "waterfall" seating surface which improves the comfort of a user leaning back against the seatback. The long side seatback of the chaise abuts the short side seatback and is formed with an inwardly curving end surface which mates with the outwardly curving seating surface of the short side seatback.

With regard to the sofa, the long side seatback, similar to that of the chaise, features a rectangular lower portion and an upper portion having a flowing "waterfall" curved seating surface. The short side seatback of the sofa, unlike the chaise, is of generally rectangular construction. The short and long side seatbacks of the sofa abut each other along a planar, i.e. non-curved surface.

Both the chaise and sofa kit may be assembled with a single Allen wrench. The long side seatbacks attach to the furniture base via angle brackets (one of which includes a nut or nut plate) and Allen screws or bolts. The short-side seatbacks attach to the furniture base with alien screws and nuts.

A feature of the present invention chaise and sofa is that in both designs, the short side seatback can be readily placed at either end of the base and still smoothly abut the long side seatback, allowing for mirror image right and left hand configurations.

DETAILED DESCRIPTION OF THE PREFERRED EMBODIMENTS

The present invention will now be described more fully hereinafter with reference to the accompanying drawings, in which preferred embodiments of the invention are shown. The invention may, however, may be embodied in many different forms and should not be construed as being limited to the embodiments set forth herein. Rather these embodiments are provided so that this disclosure will be thorough and complete, and will fully convey the scope of the invention to those skilled in the art. Like numbers refer to like elements throughout.

The Chaise Lounge

Figure 4:
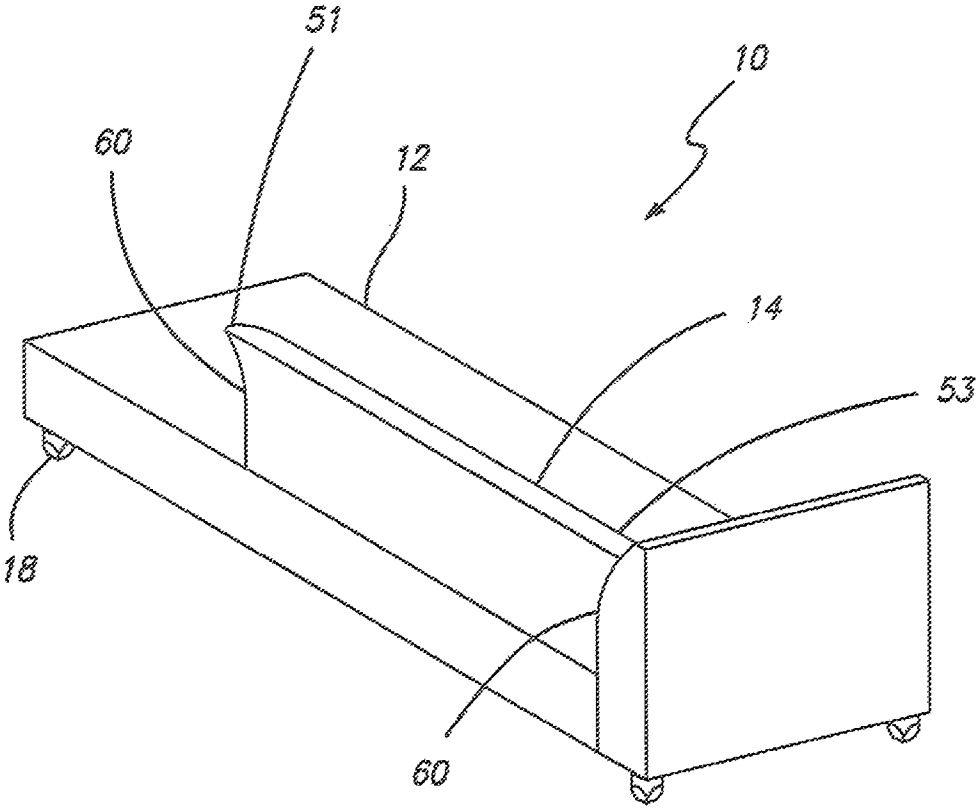
FIG. 4 is a rear perspective view of a fully assembled chaise showing the curved abutment of the long and short side chaise seatbacks.
Figure 5:
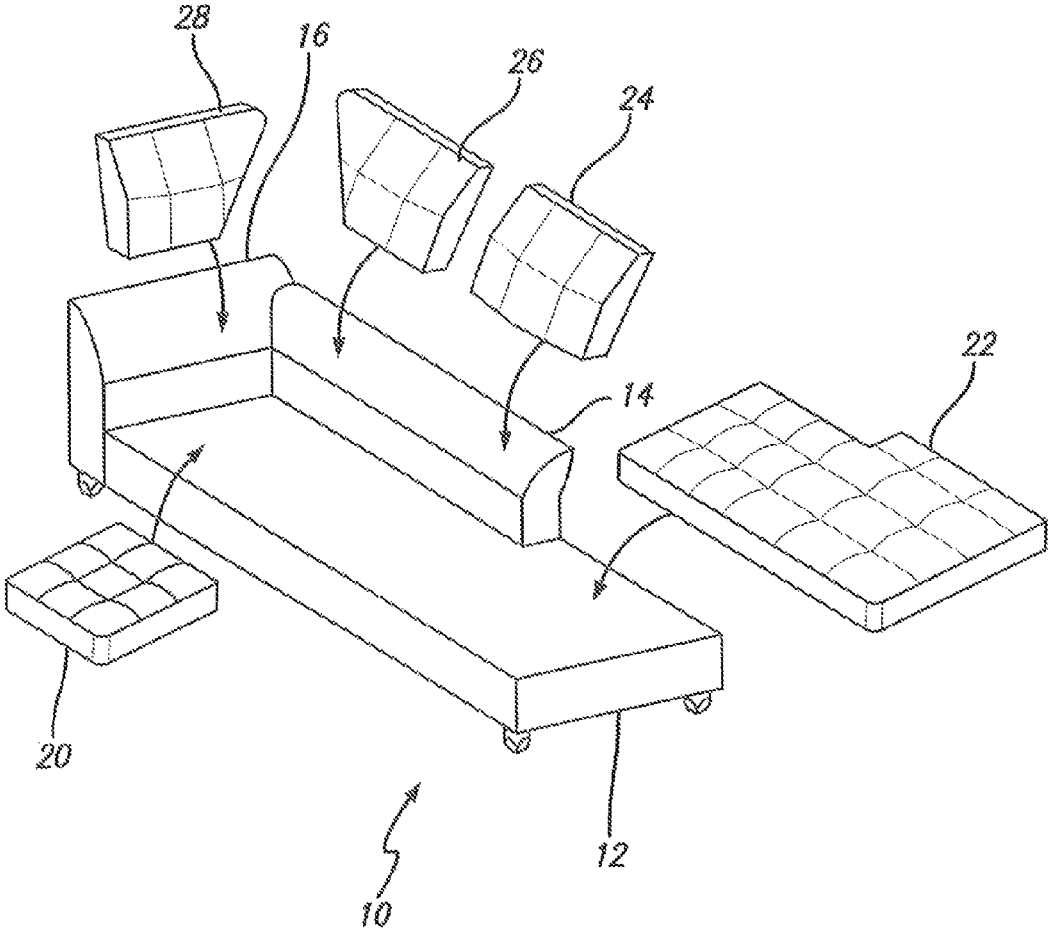
FIG. 5 is a front perspective view of the fully assembled chaise showing the placement of seat cushions on the chaise.

With reference to FIGS. 4 and 5, a chaise lounge or chaise 10 in accordance with the present invention is shown. The chaise 10 is comprised of the following principle components, a base 12, a long side seatback 14, a short side seatback 16, legs 18, base seat cushions 20 and 22, a short side seatback seat cushion 28, and long side seatback seat cushions 24 and 26.

Figure 1:
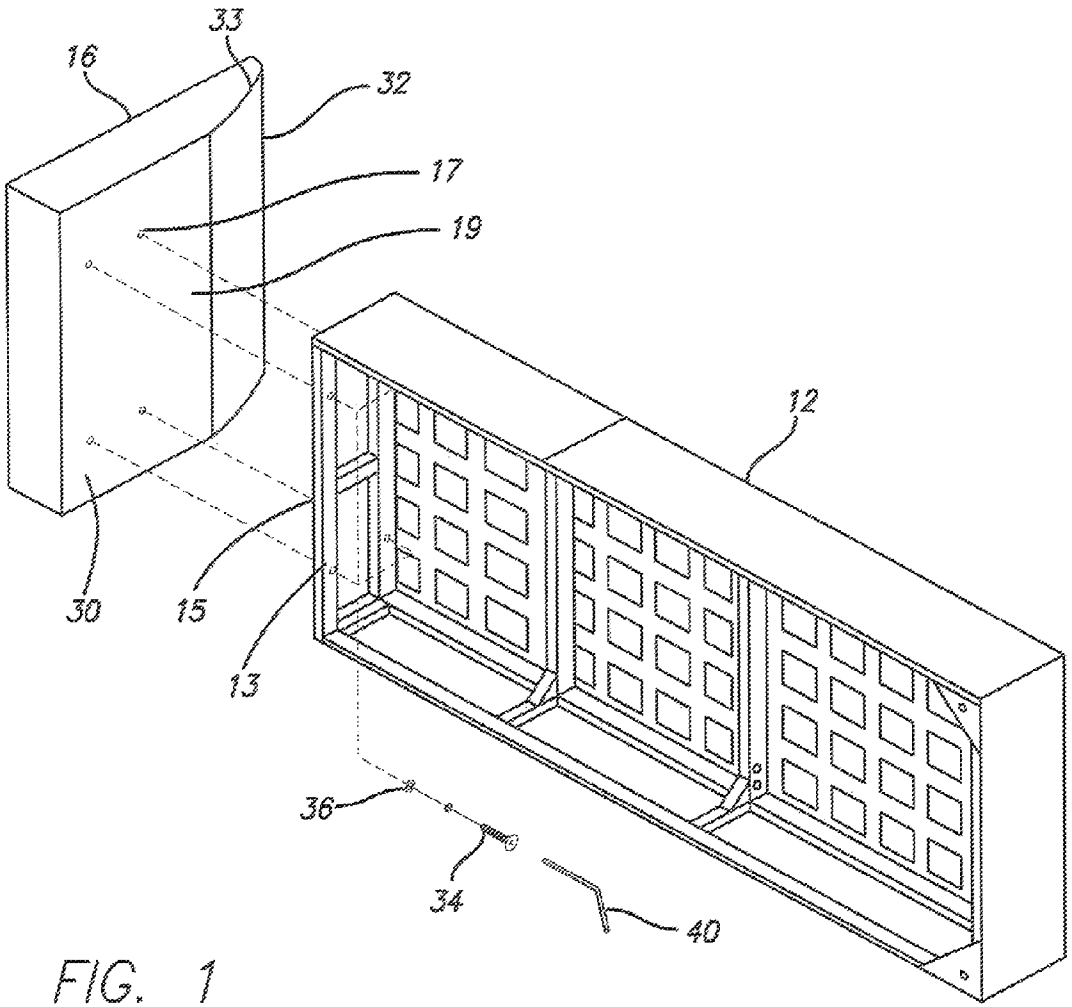
FIG. 1 is an exploded view showing how the short side chaise seatback is attached to the chaise base.

Referring now to FIG. 1, the chaise base 12 is a generally rectangular, upholstered structure. The short side seatback 16 is an upholstered structure comprising a generally rectangular lower section 30 and an upper section 32 having an outwardly curving seating surface 33. Four clearance holes 13 are provided on a side 15 of the base 12 to be attached to a side 19 of the short side seatback 16. The clearance holes 13 align with nuts 17 disposed in the short side seatback 16. The base 12 is attached to the short side seatback 16 via Allen screws or bolts 34. A flat washer 36 is placed on each Allen screw 34. The screws or bolts are then passed through the clearance holes 13 in the base 12 to engage the nuts 17 in the short side seatback 16. The Allen screws 34 are secured to the nuts 17 by tightening the screws with an Allen wrench 40.

Figure 12:
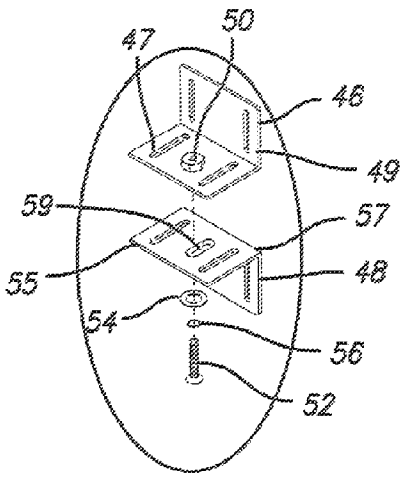
FIG. 12 is a detail of the angle brackets and fasteners used to attach the long side chaise seatback to chaise base and the long side sofa seatback to the sofa base.
Figure 2:
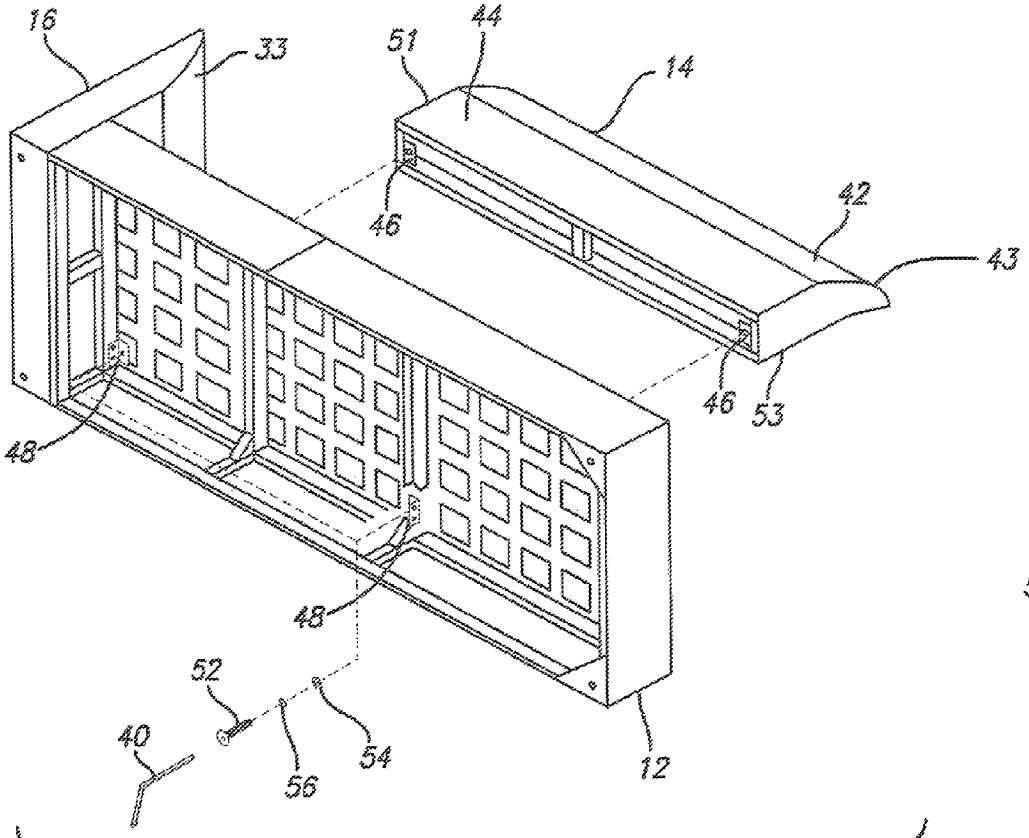
FIG. 2 is a partially exploded view showing the chaise base attached to the short side chaise seatback and how the long side chaise seatback is attached to the chaise base.

Referring now to FIGS. 2 and 12, the chaise base 12 with the short side chaise seatback 16 attached, is shown. In position for attachment to the base 12 is the long side chaise seatback 14. The long side seatback 14 is an upholstered structure comprising a generally rectangular lower section 44 and an upper section 42 having an outwardly curving seating surface 43. The long side seatback 14 includes end surfaces 51 and 53. Attached to the long side seatback 14 at each end surface 51 and 53 are upper angle brackets 46. The upper angle brackets 46 include a vertical flange 49, which attaches to a respective end surface 51, 53, as well as a horizontal flange 47. Attached to the horizontal flange 47 of the upper bracket 46 is a nut or nut plate 50.

With continued reference to FIGS. 2 and 12, attached to the chaise base 12 are lower angle brackets 48. Like the upper angle brackets 46, the lower brackets 48 include a vertical flange 57 which attaches to the chaise base 12 and a horizontal flange 55 which interfaces with the horizontal flange 47 of the upper angle bracket 46. The horizontal flange 55 is equipped with a clearance hole or slot 59 which aligns with the nut 50 of the upper angle bracket 46. The long side seatback 14 is attached to the chaise base 12 via Allen screws 52, lock washers 56 and washers 54. The screws pass through the hole or slot 59 in the lower angle bracket 48 to engage the nut 50 attached to the upper angle bracket 46. The screws 52 are securely tightened using the supplied Allen wrench 40.

Referring now to FIG. 2, based upon the inventor's many years of experience in the furniture making art, it is believed that the outwardly curving seating surface 33 of the short side seatback 16, and the outwardly curving seating surface 43 of the long side seatback 14 provide improved comfort to a person sitting on the chaise with his back resting against either of the curved seating surfaces 33, 43 of the seatbacks 14 and 16.

The curved seating surfaces 33, 43 of the long side 14 and short side 16 seatbacks both face inwardly of the base 12, when installed on the base, i.e. when a consumer seats on the base and leans against the seatbacks, the user's back will rest upon the curved portions of the seatbacks. In the exemplary embodiment, the long side seatback 14 is of shorter height than the short side seatback 16. However, both seatbacks could be made the same height or relative heights of the seatbacks could be reversed.

Referring now to FIGS. 2 and 4, the long side seatback 14 is formed with end surfaces 51 and 53 having an inwardly curved end curvature 60, which allows the end surfaces to smoothly abut the outwardly curved seating surface 33 of the short side seatback 16. A feature of the chaise lounge 10 is that both of the end surfaces 51 and 53 of the long side seatback are formed with the inwardly curving end curvature 60. This allows the short side seatback 16 to be placed on either end of the base 12, as may be desired by the manufacturer or consumer, because the long side seatback 14, being inwardly curved at both ends, will mate to the outwardly curved seating surface 33 of the short side seatback 16, regardless of on which end of the base 12, it is placed.

Figure 3:
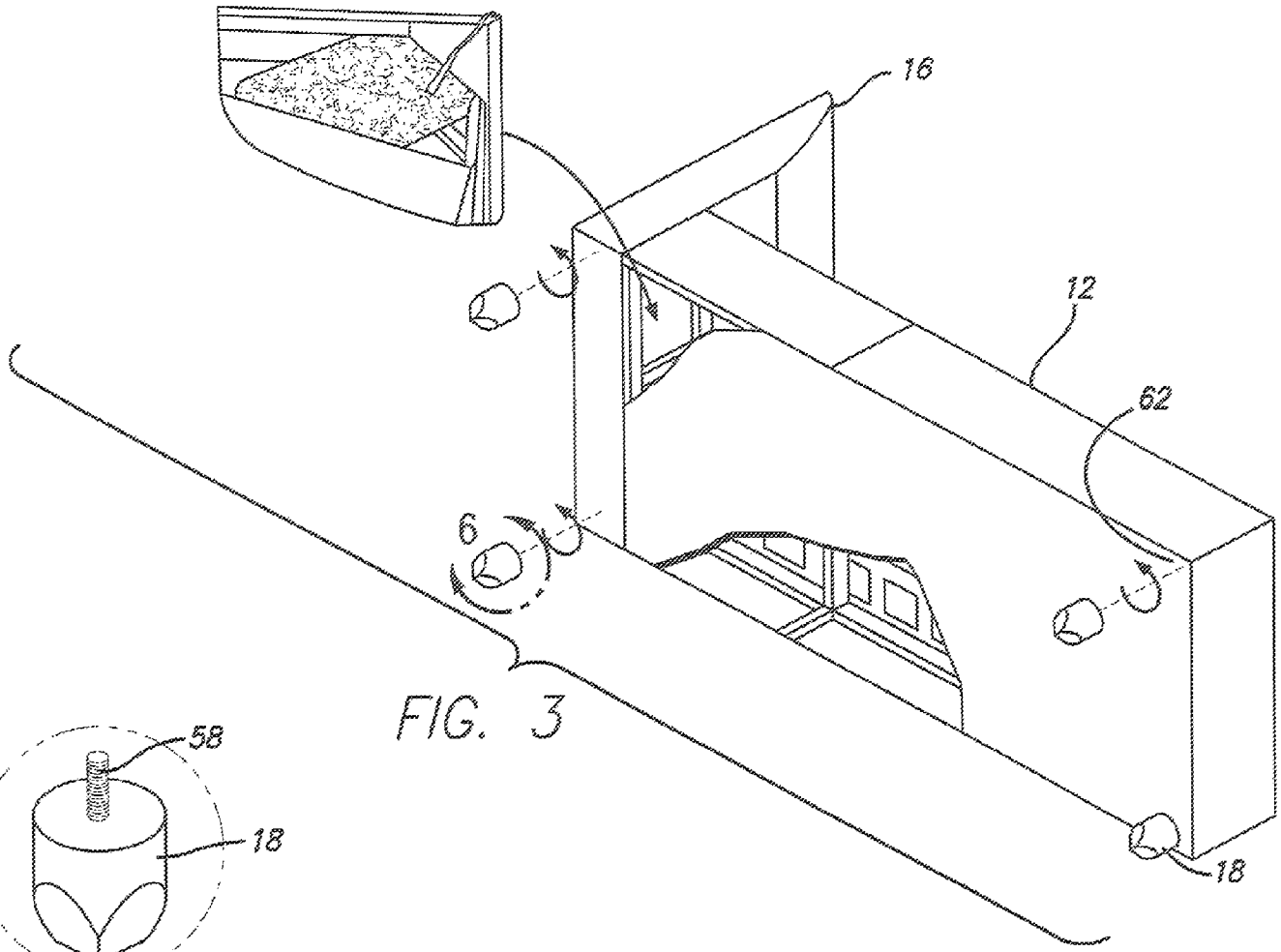
FIG. 3 is a partially exploded view showing the installation of the furniture legs to the chaise base.
Figure 6:
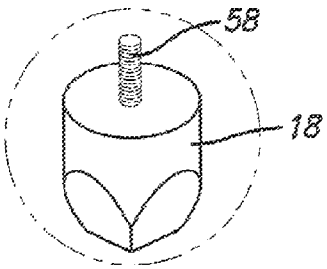
FIG. 6 is a detail of the furniture leg of the chaise.

Referring now to FIGS. 3 and 6, the chaise 10 is equipped with furniture legs 18. The legs 18 are equipped with threaded studs 58, which engage nuts 62 which are affixed to each corner of the base 12. The legs 18 are rotated clockwise until the studs 58 tightly engage the nuts 62.

Referring now to FIG. 5, the fully assembled chaise 10 is shown. Also shown are the placement of base seat cushions 20 and 22, long side seatback seat cushions 24 and 16, and short side seatback cushion 28. The base and seatback cushions may be made from a wide variety of fabrics in a variety of patterns, as is known in the art.

The Sofa

Figure 11:
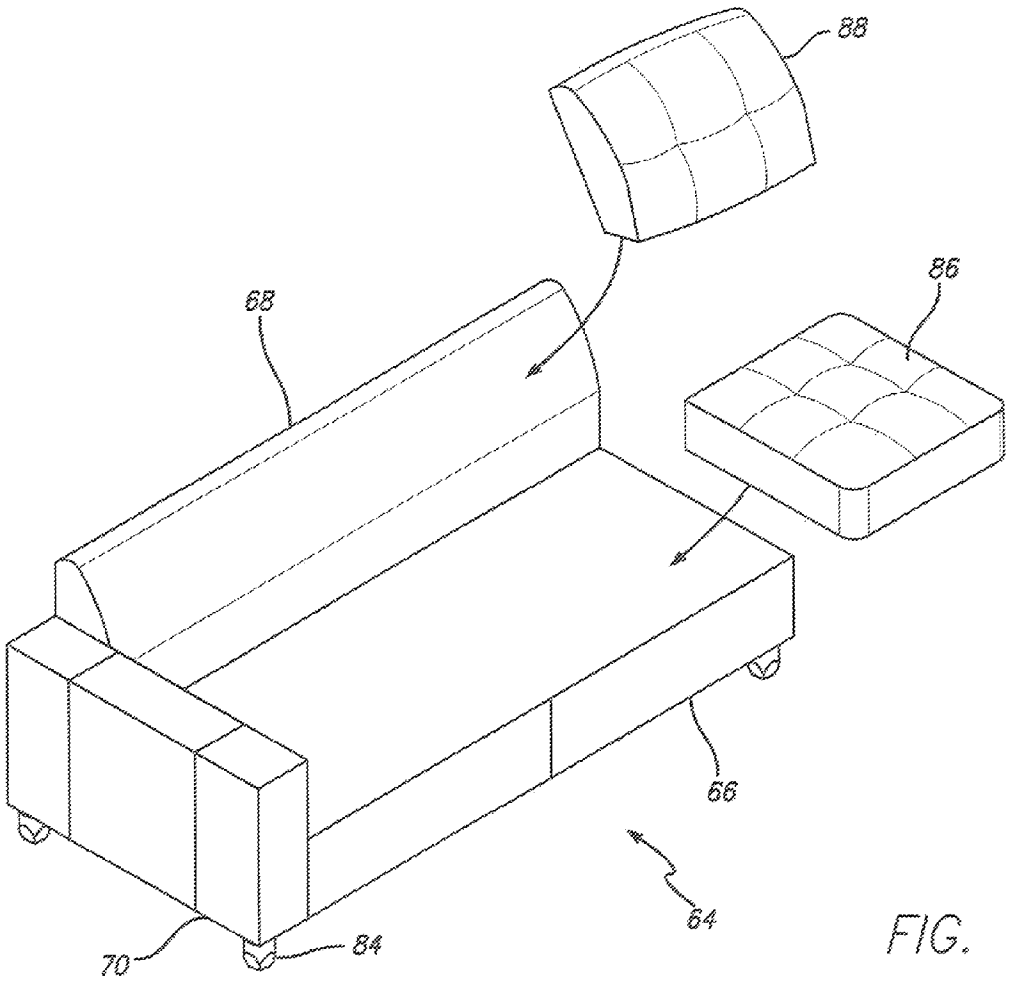
FIG. 11 is a front perspective view of the fully assembled sofa showing the placement of seat cushions on the sofa.

With reference to FIG. 11, a sofa 64 in accordance with the present invention is shown. The sofa 64 is comprised of the following principle components, a base 66, a long side seatback 68, a short side seatback 70, legs 84, base seat cushions 86, and long side seatback seat cushions 88.

Figure 7:
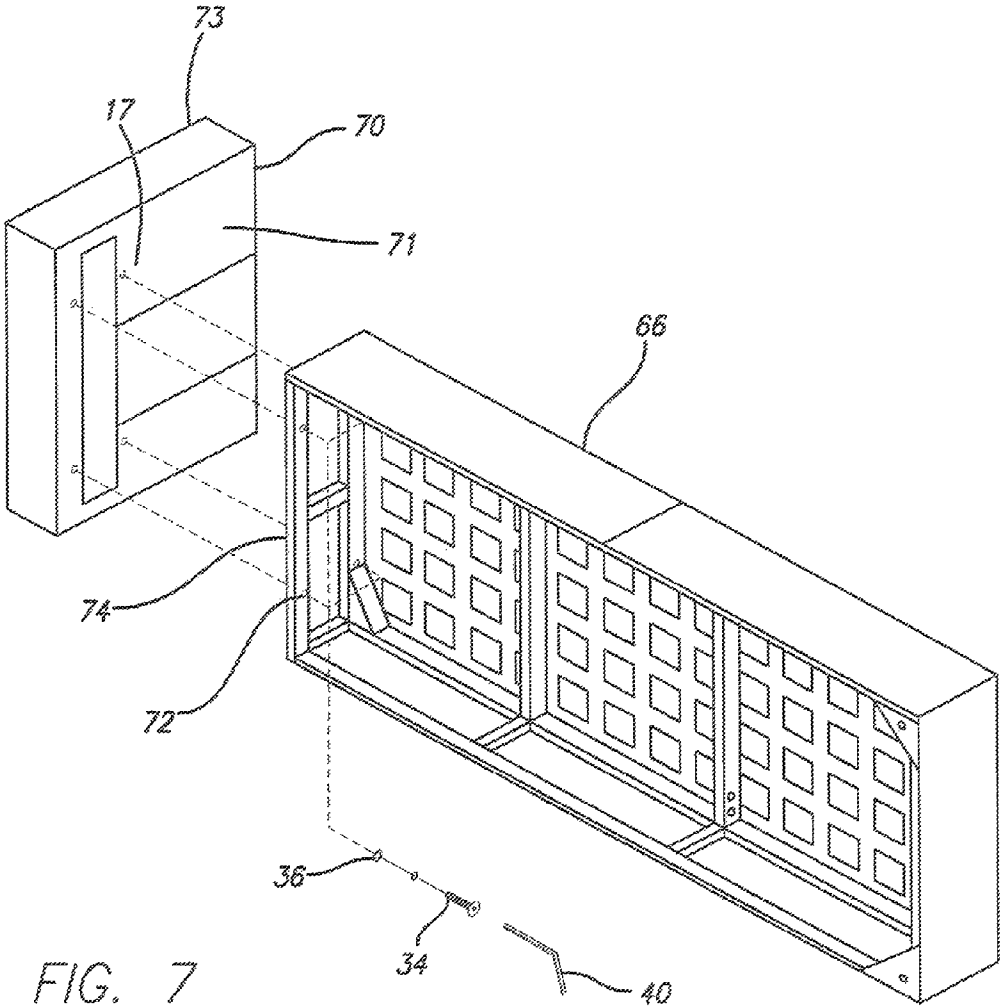
FIG. 7 is an exploded view showing how the short side sofa seatback is attached to the sofa base.

Referring now to FIG. 7, the sofa base 66 is a generally rectangular, upholstered structure. The short side seatback 70 is a generally rectangular upholstered structure, having planar side surfaces 71 and 73. Four clearance holes 72 are provided on a side 74 of the sofa base 66 to be attached to a side surface 71 or 73 of the short side seatback 70. The clearance holes 72 align with nuts 17 disposed in the short side seatback 70. The sofa base 66 is attached to the short side seatback 70 via Allen screws 34. A flat washer 36 is placed on each allen screw 34. The screws are then passed through the clearance holes 72 in the base 66 to engage the nuts 17 in the short side seatback 70. The Allen screws 34 are secured to the nuts 17 by tightening the screws with an Allen wrench 40.

Figure 8:
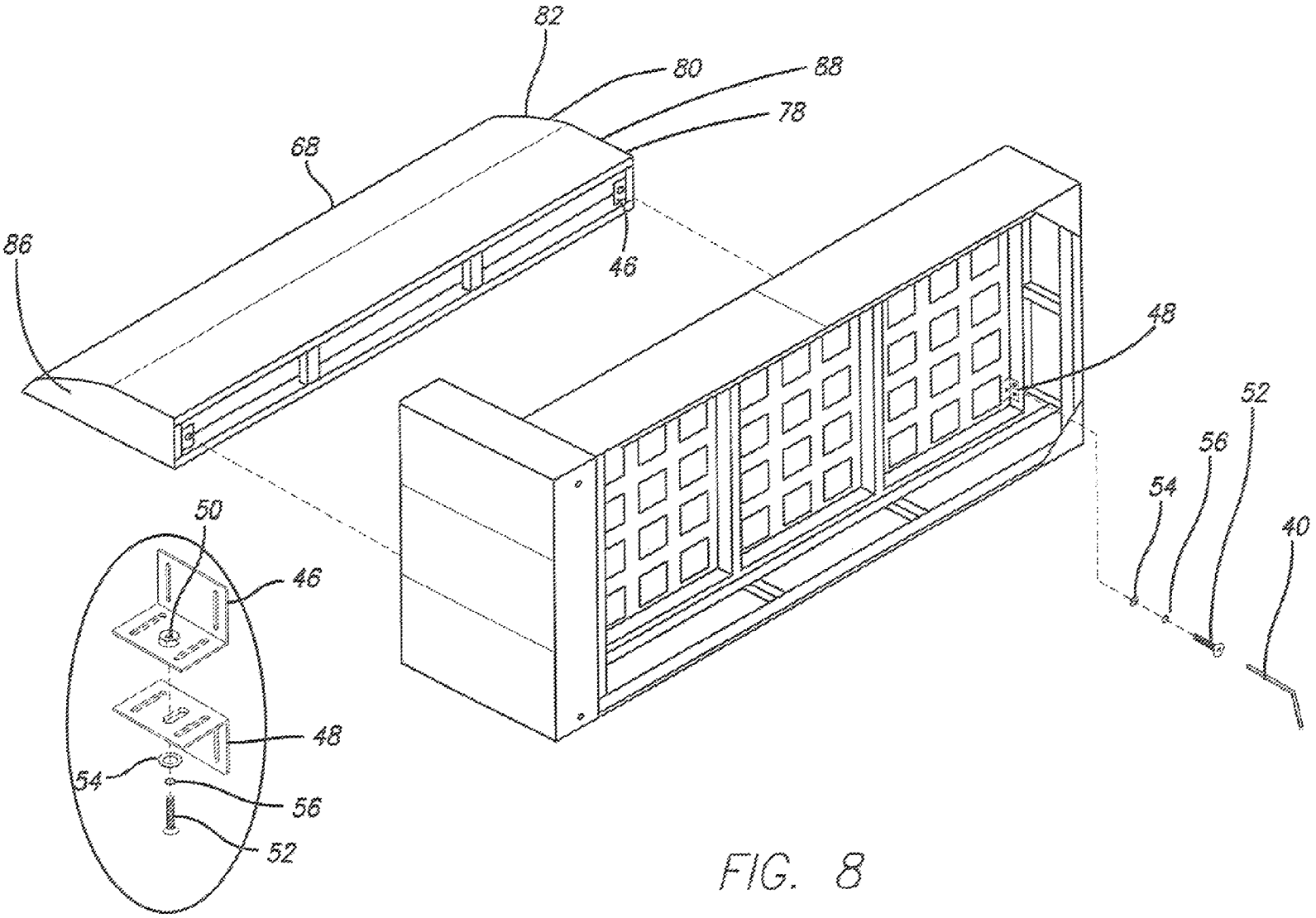
FIG. 8 is a partially exploded view showing the sofa base attached to the short side sofa seatback, and how the long side sofa seatback is attached to the sofa base.

Referring now to FIGS. 8 and 12, the sofa base 66 with the short side sofa seatback 70 attached, is shown. In position for attachment to the base 66 is the long side sofa seatback 68. The long side seatback 68 is an upholstered structure comprising a generally rectangular lower section 78 and an upper section 82 having an outwardly curving seating surface 80. The long side seatback 68 includes planar end surfaces 86 and 88. Attached to the long side seatback 66 at each end surfaces 86 and 88 are upper angle brackets 46. The construction of the upper angle brackets 46 is discussed above, with respect to the chaise 10.

With continued reference to FIGS. 2 and 12, attached to the sofa base are lower angle brackets 48. The construction of the lower angle brackets 48 is discussed above, with respect to the chaise 10. The long side seatback 68 of the sofa 64 is attached to the sofa base 66 via Allen screws 52, lock washers 56 and washers 54. The screws pass through the hole or slot 59 in the lower angle bracket 48 to engage the nut 50 attached to the upper angle bracket 46. The screws 52 are securely tightened using the supplied Allen wrench 40.

Based upon the inventor's many years of experience in the furniture making art, it is believed that the outwardly curving seating surface 80 of the long side sofa seatback 68 provides improved comfort to a person sitting in the sofa with his back resting against the long side sofa seatback 68. In the exemplary embodiment, the long side seatback 68 is of greater height than the short side seatback 70. However, both seatbacks could be made the same height or relative heights of the seatbacks could be reversed.

Referring now to FIG. 11, the long side seatback 66 is formed with planer end surfaces 86 and 88. The planar end surfaces 86 and 88 of the long side seat back 66, allow the short side seatback 70 to be placed on either end of the base 64, as may be desired by the manufacturer or consumer, because long side seatback 66, having planer end surfaces, 86, 88 will abut the planar side surfaces 71, 73 of the short side seatback 70, regardless of on which end of the base 66, it is placed.

Figure 9:
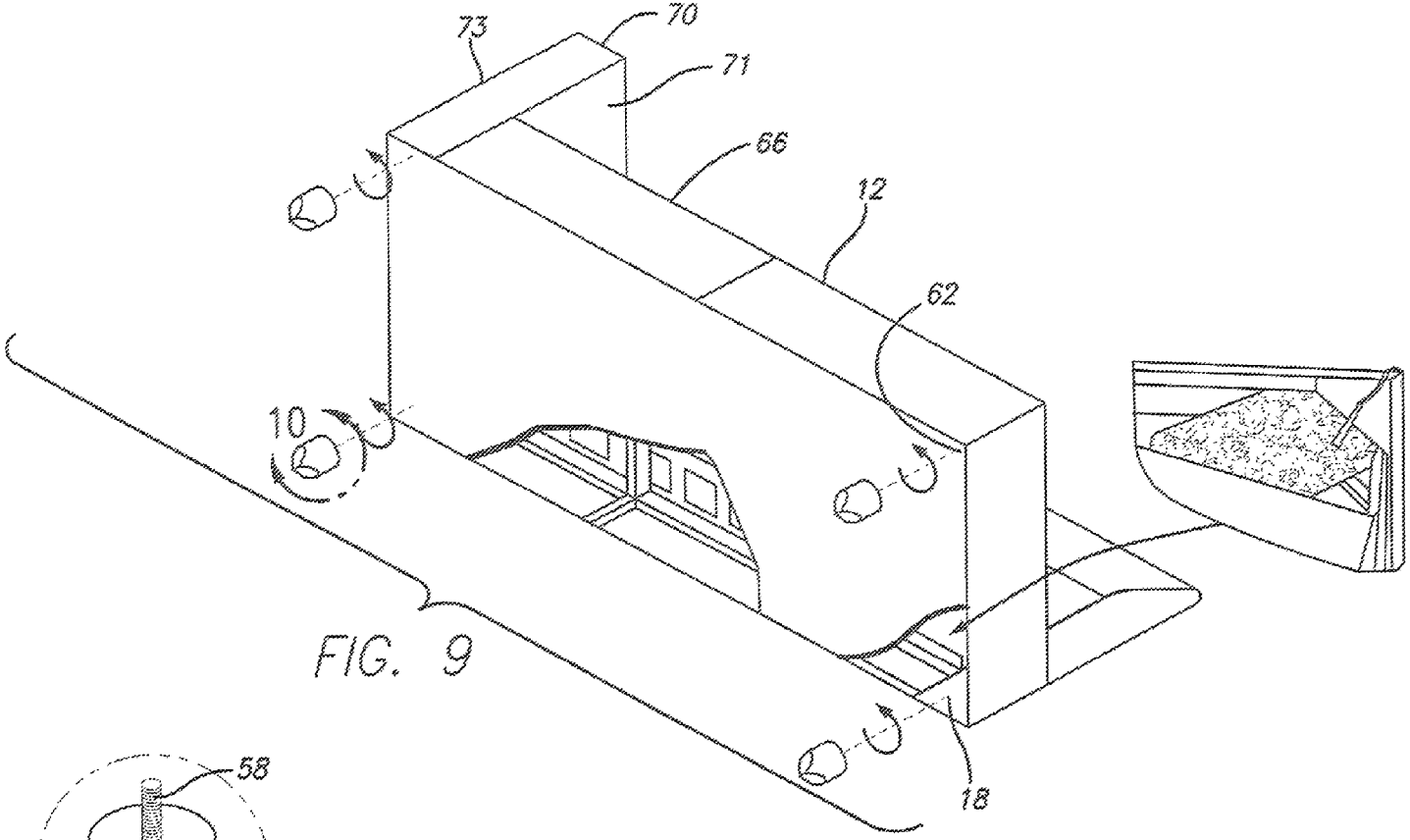
FIG. 9 is a partially exploded view showing the installation of the furniture legs to the sofa base.
Figure 10:
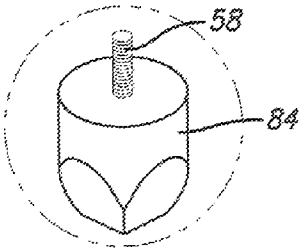
FIG. 10 is a detail of the furniture leg of the sofa.

Referring now to FIGS. 9 and 10, the sofa 64 is equipped with furniture legs 84. The legs 84 are equipped with threaded studs 58, which engage nuts 62 which are affixed to each corner of the base 66. The legs 84 are rotated clockwise until the studs 58 tightly engage the nuts 62.

Referring now to FIG. 11, the fully assembled sofa 64 is shown. Also shown are the placement of the base seat cushions 86 and the long side seatback seat cushions 88. Only one base and long side seat cushion is shown in FIG. 11, however multiple cushions may be used. The cushions may be made from a wide variety of fabrics in a variety of patterns, as is known in the art.

The foregoing detailed description and appended drawings are intended as a description of the presently preferred embodiment of the invention and are not intended to represent the only forms in which the present invention may be constructed and/or utilized. Those skilled in the art will understand that modifications and alternative embodiments of the present invention which do not depart from the spirit and scope of the foregoing specification and drawings, and of the claims appended below are possible and practical. It is intended that the claims cover all such modifications and alternative embodiments.

The invention claimed is:

1. A chaise lounge kit, comprising:

a generally rectangular base;

a short side seatback, the short side seatback comprising a generally rectangular lower portion and an upper portion having an outwardly curving seating surface facing inwardly of the base, against which a user may rest;

a long side seatback, the long side seatback comprising a generally rectangular lower portion and an upper portion having an outwardly curving seating surface facing inwardly of the base, against which a user may rest;

the long side seatback further including an inwardly curving end surface which abuts the outwardly curving seating surface of the short side seatback when assembled;

means for connecting the short side seatback to the base;

wherein the means for connecting the short side seatback to the base comprises clearance holes in the base, nuts affixed to the short side seatback, configured to align with the clearance holes in the base, wherein a bolt passes through each clearance hole in the base to engage each aligned nut in the short side seatback; and means for connecting the long side seatback to the base;

wherein the means for connecting the long side seatback to the base comprises upper and lower angle brackets, nuts and bolts, the upper angle brackets being attached to the long side seatback, the lower angle brackets being attached to the base, each upper angle bracket including a nut affixed thereto, each lower angle bracket including a clearance hole for the bolt, wherein the nuts and clearance holes are aligned, wherein the long side seatback is secured to the base by passing bolts through the clearance holes in the lower angle brackets to engage the respective aligned nuts affixed to the upper angle brackets.

2. The chaise lounge kit of claim 1, wherein the long side seatback is formed with two inwardly curving end surfaces, one at each end of the seatback, so that the long side seatback will abut with the outwardly curving seating surface of the short side seatback, regardless of on which side of the base the short side seatback is attached.

3. The chaise lounge kit of claim 1, wherein the base, long side seatback and short side seatback are upholstered.

4. The chaise lounge kit of claim 1, wherein the long side seatback and short side seatbacks are of different heights.

5. The chaise lounge kit of claim 1, wherein the clearance hole in the lower angle bracket is a slot.

6. The chaise lounge kit of claim 1, wherein the clearance hole in the base is a slot.

7. A chaise lounge kit, comprising:

a generally rectangular base;

a short side seatback, the short side seatback comprising a generally rectangular lower portion and an upper portion having an outwardly curving seating surface facing inwardly of the base, against which a user may rest;

a long side seatback, the long side seatback comprising a generally rectangular lower portion and an upper portion having an outwardly curving seating surface facing inwardly of the base, against which a user may rest;

the long side seatback further including an inwardly curving end surface which abuts the outwardly curving seating surface of the short side seatback when assembled;

means for connecting the short side seatback to the base;

means for connecting the long side seatback to the base, and wherein the means for connecting the long side seatback to the base comprises upper and lower angle brackets, nuts and bolts, the upper angle brackets being attached to the long side seatback, the lower angle brackets being attached to the base, each upper angle bracket including a nut affixed thereto, each lower angle bracket including a clearance hole for the bolt, wherein the nuts and clearance holes are aligned, wherein the long side seatback is secured to the base by passing bolts through the clearance holes in the lower angle brackets to engage the respective aligned nuts affixed to the upper angle brackets.

8. The chaise lounge kit of claim 7, wherein the long side seatback is formed with two inwardly curving end surfaces, one at each end of the seatback, so that the long side seatback will abut with the outwardly curving seating surface of the short side seatback, regardless of on which side of the base the short side seatback is attached.

9. The chaise lounge kit of claim 7, wherein the long side seatback and short side seatbacks are of different heights.

10. The chaise lounge kit of claim 7, wherein the clearance hole in the lower angle bracket is a slot.

11. The chaise lounge kit of claim 7, wherein the means for connecting the short side seatback to the base comprises clearance holes in the base, nuts affixed to the short side seatback, configured to align with the clearance holes in the base, wherein a bolt passes through each clearance hole in the base to engage each aligned nut in the short side seatback.

12. The chaise lounge kit of claim 11, wherein the clearance hole in the base is a slot.

13. A sofa kit, comprising:

a generally rectangular base;

a short side seatback, the short side seatback comprising a generally rectangular structure;

a long side seatback, the long side seatback comprising a generally rectangular lower portion and an upper portion having an outwardly curving seating surface facing inwardly of the base, against which a user may rest;

the long side seatback having a planar end surface which abuts a planar side surface of the short side seatback when assembled;

means for connecting the short side seatback to the base;

means for connecting the long side seatback to the base, and wherein the means for connecting the long side seatback to the base comprises upper and lower angle brackets, nuts and bolts, the upper angle brackets being attached to the long side seatback, the lower angle brackets being attached to the base, each upper angle bracket including a nut affixed thereto, each lower angle bracket including a clearance hole for the bolt, wherein the nuts and clearance holes are aligned, wherein the long side seatback is secured to the base by passing bolts through the clearance holes in the lower angle brackets to engage the respective aligned nuts affixed to the upper angle brackets.

14. The sofa kit of claim 13, wherein the clearance hole in the lower angle bracket is a slot.

15. The sofa kit of claim 13, wherein the long side seatback is formed with two planar end surfaces, one at each end of the seatback, so that the long side seatback will abut with the planer side surfaces of the short side seatback, regardless of on which side of the base the short side seatback is attached.

16. The sofa kit of claim 13, wherein the long side seatback and short side seatbacks are of different heights.

17. The sofa kit of claim 13, wherein the means for connecting the short side seatback to the base comprises clearance holes in the base, nuts affixed to the planar side surface of the short side seatback, the nuts configured to align with the clearance holes in the base, wherein a bolt passes through each clearance hole in the base to engage each aligned nut in the planar side surface of the short side seatback.

18. The chaise lounge kit of claim 17, wherein the clearance hole in the base is a slot.

* * * * *